US009376199B2

(12) United States Patent
Choo et al.

(10) Patent No.: US 9,376,199 B2
(45) **Date of Patent: *Jun. 28, 2016**

(54) POLAR VESSEL HAVING A DERRICK

(75) Inventors: Keum Dae Choo, Gyeongsangnam-do (KR); Yu Young Lee, Gyeongsangnam-do (KR); Jung Yul Choi, Gyeongsangnam-do (KR); Jung Soo Kang, Gyeongsangnam-do (KR); D. Scott Brittin, Katy, TX (US)

(73) Assignees: Daewoo Shipbuilding & Marine Engineering Co., Ltd., Seoul (KR); Transocean Sedco Forex Ventures Limited, George Town (KY)

( * ) Notice: Subject to any disclaimer, the term of this patent is extended or adjusted under 35 U.S.C. 154(b) by 455 days.

This patent is subject to a terminal disclaimer.

(21) Appl. No.: 13/812,015

(22) PCT Filed: Jun. 22, 2011

(86) PCT No.: PCT/KR2011/004551

§ 371 (c)(1),
(2), (4) Date: Jun. 28, 2013

(87) PCT Pub. No.: WO2012/015169

PCT Pub. Date: Feb. 2, 2012

(65) Prior Publication Data

US 2013/0269584 A1 Oct. 17, 2013

(30) Foreign Application Priority Data

Jul. 27, 2010 (KR) ..... 10-2010-0072573
Nov. 4, 2010 (KR) ..... 10-2010-0109026

(51) Int. Cl.
*B63J 2/02* (2006.01)
*B63B 35/44* (2006.01)

(Continued)

(52) U.S. Cl.
CPC ..... *B63J 2/02* (2013.01); *B63B 35/4413* (2013.01); *B63J 2/10* (2013.01); *E21B 15/00* (2013.01)

(58) Field of Classification Search
CPC ..... B63J 2/02; B63J 2/04; B63J 2/06; E21B 15/00; B63B 35/4413
USPC ..... 114/211, 264; 405/217; 454/237, 238
See application file for complete search history.

(56) References Cited

U.S. PATENT DOCUMENTS 2,153,350 A * 4/1939 Stimac ..... 123/586
2,691,272 A 10/1954 Townsend et al.

(Continued)

FOREIGN PATENT DOCUMENTS

GB 611961 A 11/1948
GB 2 110 602 A 6/1983

(Continued)

*Primary Examiner* — Andrew Polay
(74) *Attorney, Agent, or Firm* — Seed IP Law Group PLLC

(57) ABSTRACT

Provided is an arctic ship with a derrick, which can stably maintain an internal environment of an enclosed derrick. The arctic ship with a derrick includes: the derrick forming an enclosed space blocked from outside air; a moonpool coupled to a lower portion of the derrick to communicate with the derrick and blocked from the outside air; and an air supply/exhaust device installed to communicate an inner space of the derrick or the moonpool with the exterior, wherein air condition of the inner space is maintained or controlled at a predetermined range by the air supply/exhaust device.

18 Claims, 8 Drawing Sheets

(51) Int. Cl.
*B63J 2/10* (2006.01)
*E21B 15/00* (2006.01)

(56) References Cited

U.S. PATENT DOCUMENTS

| | | | | | |
|---|---|---|---|---|---|
| 2,804,951 | A | | 9/1957 | Kolt | |
| 3,093,056 | A | | 6/1963 | Rosenfeld | |
| 3,279,407 | A | | 10/1966 | Stenger | |
| 3,461,828 | A | | 8/1969 | Bielstein | |
| 3,593,645 | A | | 7/1971 | Day et al. | |
| 3,850,125 | A | | 11/1974 | Anders | |
| 4,053,732 | A | | 10/1977 | Carter | |
| 4,487,214 | A | | 12/1984 | Tatum | |
| 4,613,001 | A | | 9/1986 | Edberg et al. | |
| 4,627,767 | A | * | 12/1986 | Field et al. | 405/196 |
| 4,666,341 | A | | 5/1987 | Field et al. | |
| 4,991,532 | A | * | 2/1991 | Locke | 114/211 |
| 5,927,222 | A | | 7/1999 | Eakin et al. | |
| 7,413,007 | B2 | | 8/2008 | Yamaoka | |
| 2003/0196791 | A1 | * | 10/2003 | Dunn et al. | 166/77.51 |
| 2005/0191136 | A1 | | 9/2005 | Xu | |
| 2008/0115998 | A1 | | 5/2008 | Naganuma et al. | |
| 2010/0291857 | A1 | | 11/2010 | Cho et al. | |

FOREIGN PATENT DOCUMENTS

| | | | |
|---|---|---|---|
| JP | 60-62394 | A | 4/1985 |
| JP | 60-126589 | U | 8/1985 |
| JP | 63-6998 | U | 1/1988 |
| JP | 2-100994 | U | 8/1990 |
| JP | 3002545 | B2 | 1/2000 |
| JP | 2000238695 | A | 9/2000 |
| JP | 2005-306315 | A | 11/2005 |
| KR | 20-0226940 | Y1 | 6/2001 |
| KR | 20-0431766 | A | 3/2004 |
| KR | 20-0431766 | Y1 | 11/2006 |
| KR | 10-2009-0053184 | A | 5/2009 |
| KR | 10-2010-0028480 | A | 3/2010 |
| WO | 97/42393 | A1 | 11/1997 |

* cited by examiner

*(Prior Art)*

POLAR VESSEL HAVING A DERRICK

CROSS-REFERENCE(S) TO RELATED APPLICATION

This application is a national stage application filed under 35 U.S.C. §371 of International Application No. PCT/KR2011/004551, accorded an International Filing Date of Jun. 22, 2011, which claims priority to Korean Patent Application Nos. 10-2010-0109026, filed on Nov. 4, 2010, and 10-2010-0072573, filed on Jul. 27, 2010, in the Korean Intellectual Property Office, each of which is hereby incorporated by reference in its entirety.

BACKGROUND

1. Technical Field

The present disclosure relates to an arctic ship with a derrick, and more particularly, to an arctic ship with a derrick, which can stably maintain an internal environment of an enclosed derrick.

2. Description of the Related Art

Due to the rapid international industrialization and industrial development, the use of the earth's resources, such as oil, is gradually increasing. Accordingly, stable production and supply of oil is emerging as a very important worldwide issue.

For this reason, much attention has recently been paid to development of small marginal fields or deep-sea oil fields, which have been ignored because of their low economic feasibility. Therefore, with the development of offshore drilling techniques, drill ships equipped with drilling equipment suitable for development of such oil fields have been developed.

In conventional offshore drilling, rig ships or fixed type platforms have been mainly used, which can be moved only by tugboats and are anchored at a position on the sea using a mooring gear to conduct an oil drilling operation. In recent years, however, so-called drill ships have been developed and used for offshore drilling. The drill ships are provided with advanced drilling equipment and have structures similar to typical ships such that they can make a voyage using their own power. Since drill ships have to frequently move in order for development of small marginal fields, they are constructed to make a voyage using their own power, without assistance of tugboats.

FIG. 1 is a side view illustrating a conventional arctic ship which performs a drilling operation on the sea.

A moonpool 3 is formed at the center of a conventional arctic ship 1, such that a riser 4 or a drill pipe 5 is vertically movable through the moonpool 3. In addition, a derrick 2 in which a variety of drilling equipment is integrated is installed on a deck of the ship 1.

The conventional derrick 2 has an opened structure in which steel pipes are coupled together, like a power transmission tower installed on the ground. A crown block section in which a crown block is installed is formed at an upper portion of the derrick 2. The crown block section is formed in a conical shape that becomes narrower upwardly. In the case of the derrick having such an opened structure, natural ventilation is possible without any separate mechanical ventilating apparatus.

However, if the conventional derrick having the opened structure is installed in an arctic ship that sails around an arctic region, a variety of drilling equipment is exposed at below zero temperatures for a long time. Consequently, the drilling equipment may not operate normally. Also, due to the structural shape of the conical crown block section that becomes narrower upwardly, the worker's accessibility becomes weak.

BRIEF SUMMARY

An aspect of the present invention is directed to an arctic ship with a derrick, which can enclose the derrick in order to achieve a smooth operation in an arctic region and can monitor the temperature and pressure of the derrick and the moonpool and appropriately maintain the temperature and pressure of the derrick and the moonpool, considering influence of temperature and waves.

Another aspect of the present invention is directed to an arctic ship with a derrick, which can effectively compensate or offset a negative pressure or a positive pressure generated within an enclosed derrick and an enclosed moonpool due to influence of waves.

Another aspect of the present invention is directed to an enclosed derrick structure for an arctic ship, in which an upper portion of an enclosed derrick is gradually widened upwardly and thus a crown block platform can be used for installation and maintenance of equipment.

According to an embodiment of the present invention, an arctic ship with a derrick includes: the derrick forming an enclosed space blocked from outside air; a moonpool coupled to a lower portion of the derrick to communicate with the derrick and blocked from the outside air; and an air supply/exhaust device installed to communicate an inner space of the derrick or the moonpool with the exterior, wherein air condition of the inner space is maintained or controlled at a predetermined range by the air supply/exhaust device.

The air supply/exhaust device includes: a supply unit supplying the outside air to the derrick or the moonpool; and an exhaust unit exhausting the supplied outside air through an upper portion of the derrick.

The supply unit may include a heater which heats the supplied outside air.

The supply unit and/or the exhaust unit may include an open/close valve which opens or closes a flow of supplied or exhausted air.

The supply unit and/or the exhaust unit may include a supply louver which prevents the inflow of particles other than air.

The air supply/exhaust device may further include an openable/closable air supply port through which the outside air is supplied to the derrick.

The arctic ship may further include a heat blower provided inside the derrick to heat air in order for effective ventilation.

A supply fan may be installed in the supply unit, an exhaust fan may be installed in the exhaust unit, and the operating speeds of the supply fan and the exhaust fan may be changed depending on temperature of the outside air.

The arctic ship may further include: a duct through which the outside air supplied by the supply unit is transferred to the derrick or the moonpool; and a wire mesh provided at an end of the duct which is coupled to the derrick or the moonpool.

The air supply/exhaust device may include a damper unit installed in at least one side of the derrick to selectively supply air to the inside of the derrick or exhaust air from the inside of the derrick.

The damper unit may include: one or more communication ducts communicating an outer space of the derrick with an inner space of the derrick; and one or more open/close dampers coupled to the communication ducts to open or close the communication ducts.

The arctic ship may further include: a mesh installed in at least one of both ends of the communication duct; and an open/close damper installed in a front end of the mesh installed in the end of the communication duct within an inner space side, wherein an end of the communication duct in the outer space side is inclined downward.

The arctic ship may further include: a control unit controlling the opening/closing operation of the open/close damper; a fingerboard provided in an upper inner side of the derrick, wherein the damper unit is disposed under the fingerboard.

The arctic ship may further include: one or more temperature sensors installed in the inside of the derrick to monitor an internal temperature of the derrick; one or more pressure sensors installed in the inside of the moonpool to monitor an internal pressure of the moonpool; and a control unit controlling the operations of the supply unit and the exhaust unit, based on internal temperature and pressure information monitored by the temperature sensors and the pressure sensors.

The temperature sensors may include: a first temperature sensor installed at an upper portion of the derrick; a second temperature sensor installed at a middle portion of the derrick; and a third temperature sensor installed at a lower portion of the derrick.

The arctic ship may further include: an exhaust unit disposed in an upper inner side of the derrick; and a fingerboard disposed across a middle inner portion of the derrick. The first temperature sensor may be disposed adjacent to the exhaust unit, the second temperature sensor may be disposed above the fingerboard, and the third temperature sensor may be disposed under the fingerboard of the derrick.

The arctic ship may further include a crown block section disposed at an upper portion of the enclosed derrick such that a crown block is installed and an installation workspace is formed thereinside. The air supply/exhaust device may include an exhaust unit which exhausts air from the inside of the derrick, and the air supply/exhaust device may be installed in the crown block section such that the installation workspace communicates with the exterior.

The arctic ship may further include: a supply unit supplying the outside air to the derrick or the moonpool; and open/close valves installed in the exhaust unit and the supply unit to selectively allow an outside air flow.

The width of the crown block section may be gradually widened upwardly, and the width of the installation workspace may be gradually widened upwardly.

A pair of inclined planes may be symmetrically formed on both sides of the crown block section, such that an upper circumference of the crown block section is formed to be wider than a lower circumference thereof.

DETAILED DESCRIPTION

Figure 1:
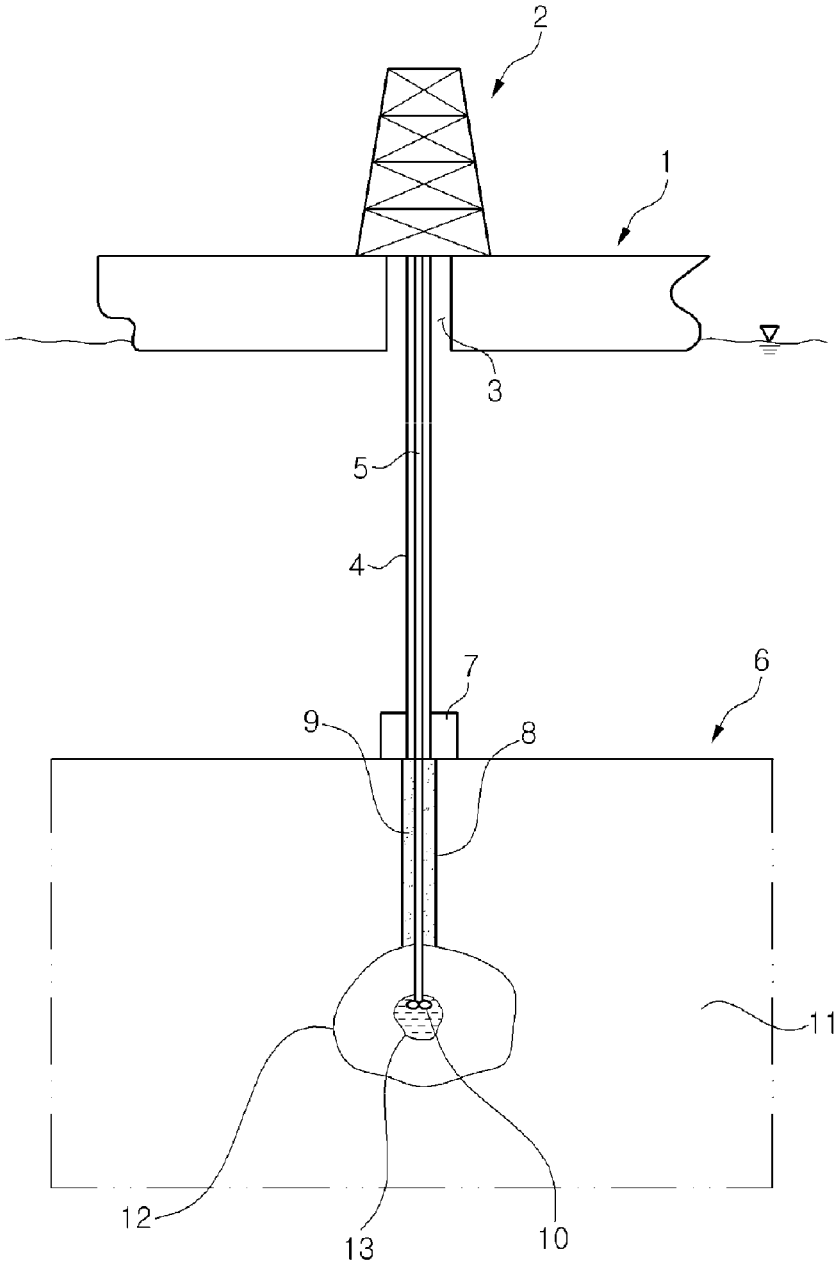
FIG. 1 is a side view illustrating a ship with a conventional derrick, which performs a drilling operation on the sea.

Exemplary embodiments of the present invention will be described below in detail with reference to the accompanying drawings. Throughout the disclosure, like reference numerals refer to like parts throughout the various figures and embodiments of the present invention.

An arctic ship with a derrick according to one or more embodiments of the present invention refers to a ship which is provided with a derrick and performs a drilling operation in an arctic region. The arctic ship according to one or more embodiments of the present invention includes any type of a ship as long as it is provided with a derrick and sails around an arctic region, such as an arctic rig ship, a fixed type arctic platform, and an arctic drill ship, without regard to a fixed type or a floating type.

Figure 2:
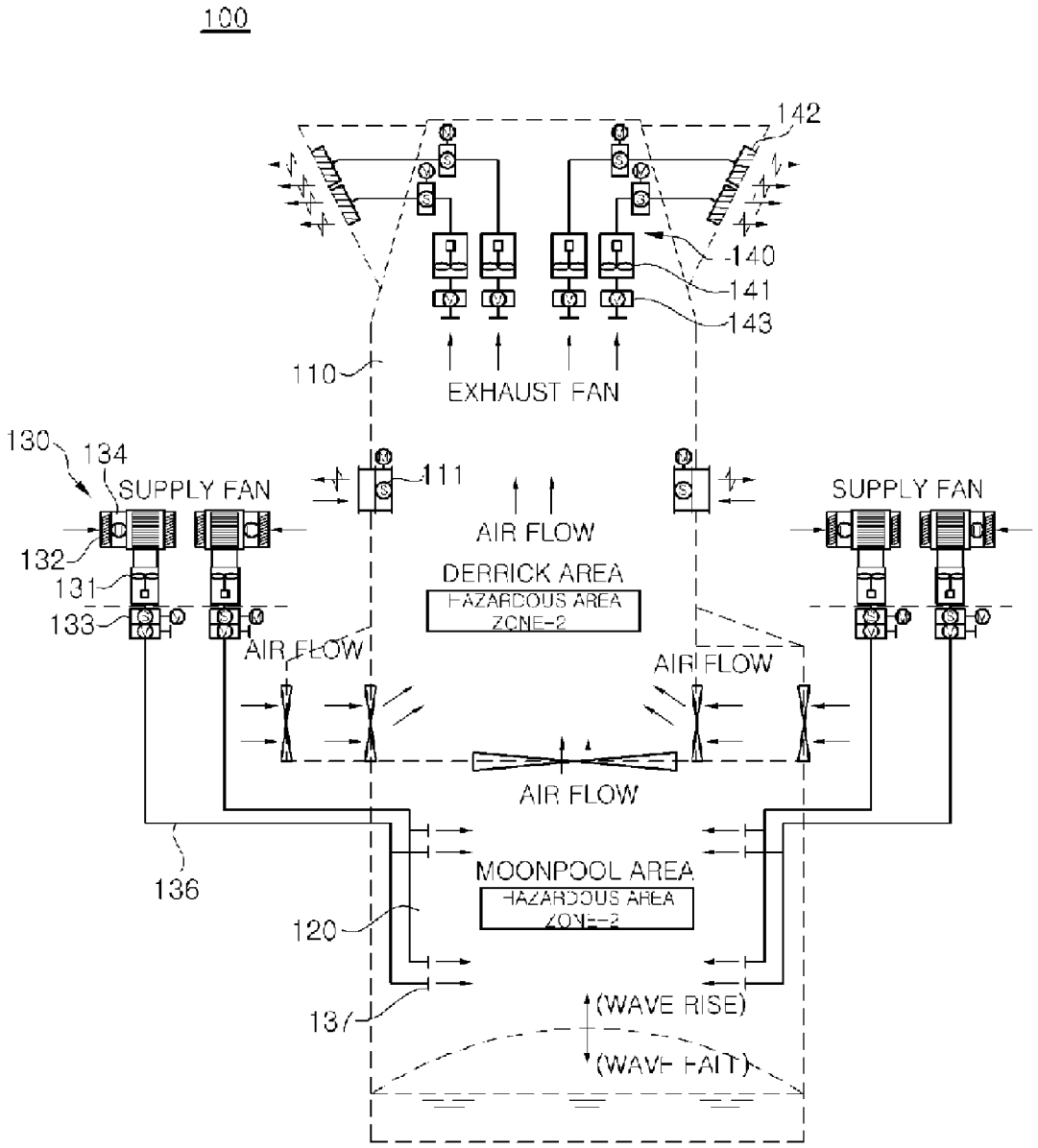
FIG. 2 is a conceptual diagram illustrating a situation in which an arctic ship with a derrick according to a first embodiment of the present invention is operating in a hot season.
Figure 3:
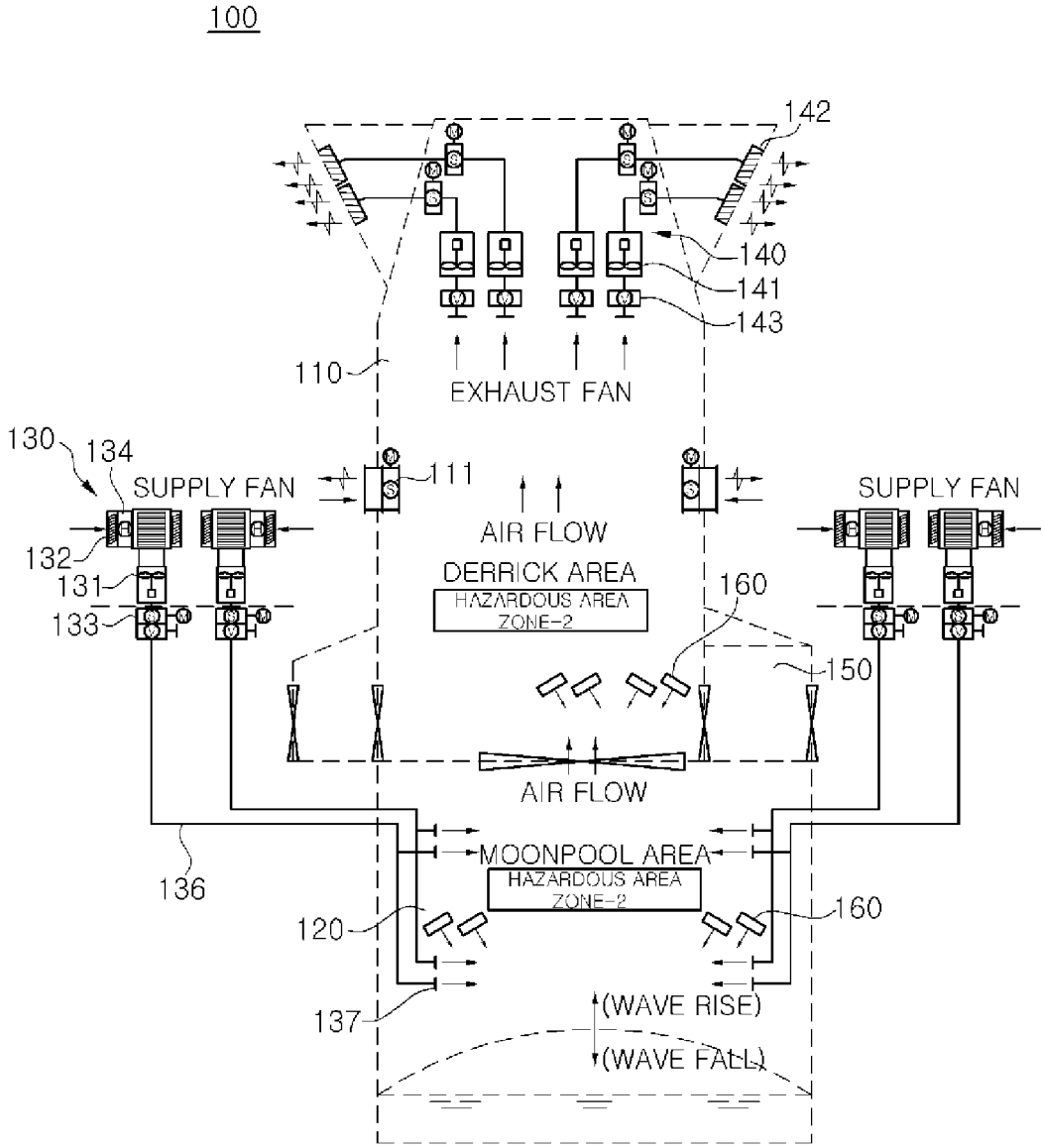
FIG. 3 is a conceptual diagram illustrating a situation in which the arctic ship with the derrick according to the first embodiment of the present invention is operating in a cold season.

With reference to FIGS. 2 and 3, a derrick 110 and a moonpool 120 are ventilated through an air supply/exhaust device according to one or more embodiments of the present invention. The derrick 110 is fixedly installed on a deck (not shown) of an arctic ship 100 and the moonpool 120 is formed under the derrick 110, such that drills for a drilling operation or the like move downwardly through the derrick 100 and the moonpool 120. Since this is well known in the shipbuilding industry, detailed description thereof will be omitted for conciseness.

Since the arctic ship 100 to which the present disclosure is directed sails around the arctic region, the derrick 110 has an enclosed structure blocked from the exterior so as to prevent air having a temperature below zero from being directly contacted with a variety of drilling equipment inside the derrick 110.

Although the terms "hot season" and "cold season" are used in this specification, they represent the conditions of the arctic region and thus it should be noted that a temperature does not exceed 10° C. even in a hot season.

FIG. 2 is a conceptual diagram illustrating a situation in which an arctic ship with a derrick according to a first embodiment of the present invention is operating in a hot season, and FIG. 3 is a conceptual diagram illustrating a situation in which the arctic ship with the derrick according to the first embodiment of the present invention is operating in a cold season.

In the case of the arctic ship 100 with the derrick according to the first embodiment of the present invention, even though it sails around the arctic region, it can prevent the internal temperature of the arctic ship 100 from dropping rapidly and can constantly maintain temperature and pressure suitable for sailing and drilling.

To this end, the derrick 110 forms an enclosed space blocked from outside air, and the moonpool 120 is coupled to a lower portion of the derrick 110 to communicate with the derrick 110, whereby the moonpool 120 is blocked from the outside air.

In addition, an air supply/exhaust device is installed to communicate an inner space of the derrick 110 or the moonpool 120 with the exterior. Therefore, since air is allowed to flow between the inner space and the outer space of the derrick 110 or the moonpool 120, an air condition (temperature, pressure, etc.) of the inner space can be maintained or controlled in a predetermined range.

As illustrated in FIGS. 2 and 3, the air supply/exhaust device may include a supply unit 130 and an exhaust unit 140. The supply unit 130 supplies fresh outside air to the inside of the derrick 110 through a supply fan 131 installed in the outside of the derrick 110.

In the case where the supply unit 130 according to the present embodiment of the invention is operated in a hot season, air can be supplied considering the temperature of the outside air, without operating a heater 134 which may be included in the supply unit 130.

The supplied outside air may be supplied through a duct 136 of the supply unit 130 to a space where the derrick 110 or the moonpool 120 is formed. The end of the duct 136 may be coupled to the derrick 110. However, in terms of circulation of outside air, it is more advantageous to couple the end of the duct 136 to the moonpool 120 disposed under the derrick 110, because air can be ventilated through the whole derrick 110.

A wire mesh 137 is formed at the end of the duct 136 coupled to the moonpool 120, whereby air can be effectively supplied to the moonpool 120.

The supply unit 130 includes a supply louver 132 which can allow the inflow of outside air and prevent the inflow of large particles or rainwater. In addition, the supply unit 130 includes an open/close valve 133 which can shut off an air flow in the event of a fire or other emergency.

An air supply port 150 is formed on the side of the derrick 110. The air supply port 150 may be opened in a hot season. Accordingly, outside air may flow into the derrick 110 through the air supply port 150 formed in the derrick 110, as well as the supply unit 130.

In the case where the arctic ship 100 according to the present invention sails around the arctic region in a hot season, the supply fan 131 of the supply unit 130 and an exhaust fan 141 of the exhaust unit 140 may be operated at high speed to supply and exhaust air at high speed.

Since a temperature in a hot season is relatively high as compared to a cold season, it is less likely that the derrick 110 and the moonpool 120 will be frozen. Therefore, the outside air need not stay in a space formed by the derrick 110 and the moonpool 120 for a long time. In a hot season, outside air also flow into the derrick 110 through the air supply port 150, as described above. Therefore, an amount of air for ventilation is sufficient.

The outside air supplied to the moonpool 120 flows upwardly, passes through the derrick 110, and is exhausted out of the derrick 110 through the exhaust fan 141 installed in the exhaust unit 140, as indicated by the arrows shown in FIGS. 2 and 3. In such a manner, fresh air is continuously supplied to the moonpool 120 and the derrick 110. Accordingly, even though gas or the like is generated during a drilling operation, it is exhausted immediately to the exterior, thereby ensuring the safety of operations in spite of the use of the derrick 110 having the enclosed structure.

As illustrated in FIGS. 2 and 3, an exhaust louver 142 may be provided in the exhaust unit 140. The exhaust louver 142 can allow the exhaust of air and prevent the inflow of large particles or rainwater from the exterior.

Since the derrick 110 has the enclosed structure, the internal pressure of a compartment formed by the moonpool 120 and the derrick 110 may rise or drop excessively if waves hit the opened space under the moonpool 120 which is in contact with seawater.

To prevent such a rapid pressure variation and maintain the internal pressures of the derrick 110 and the moonpool 120 at constant levels, damper units 111, 211, 311 and 411 may be installed on the side of the derrick 110 as illustrated in FIGS. 2 to 8. The damper units 111, 211, 311 and 411 suction or exhaust air according to a variation in the internal pressures of the derrick 110 and the moonpool 120.

FIG. 3 illustrates a situation in which the arctic ship with the derrick according to the first embodiment of the present invention is operating in a cold season.

Since the operation of the arctic ship of the present invention in the cold season is almost identical to the operation in the hot season, as described above with reference to FIG. 2, the following description will be focused on differences therebetween.

In the cold season of the arctic region, air temperature outside the arctic ship 100 is below zero and it is extremely cold. Therefore, cold outside air flowing into the supply unit 130 is heated to an appropriate temperature by the heater 134 installed in the supply unit 130 and is supplied to the moonpool 120 and the derrick 110.

In addition, considering below zero temperatures outside the arctic ship 100, air heated by the heater 134 needs to stay in the space formed by the derrick 110 and the moonpool 120 for a long time. Therefore, the supply fan 131 and the exhaust fan 141 may be operated more slowly than in the hot season.

It is preferable to close the air supply port 150 formed on the side of the derrick 110. Since outside air temperature is extremely low, a variety of drilling equipment may be frozen if air is supplied to the derrick 110 without being heated by the heater 134 or the like.

A plurality of heat blowers 160 may be installed inside the derrick 110 to heat air and forcibly circulate the heated air. Although the air heated by the heater 134 is supplied to the moonpool 120 and the derrick 110, a more effective air ventilation may be achieved by installing an additional heat source, separately from the heater 134, in the inside of the derrick 110, considering the cold season.

According to the arctic ship having the derrick according to the first embodiment of the present invention, ventilation of warm air into the arctic ship makes it possible to meet a temperature maintenance condition required when the arctic ship sails around the arctic region. In addition, it is possible to minimize a rapid pressure change due to the influence of waves generated in the moonpool 120.

Moreover, energy can be efficiently used by changing the method for operating the air supply/exhaust device installed in the arctic ship, depending on the cold season and the hot season of the arctic region.

Figure 4:
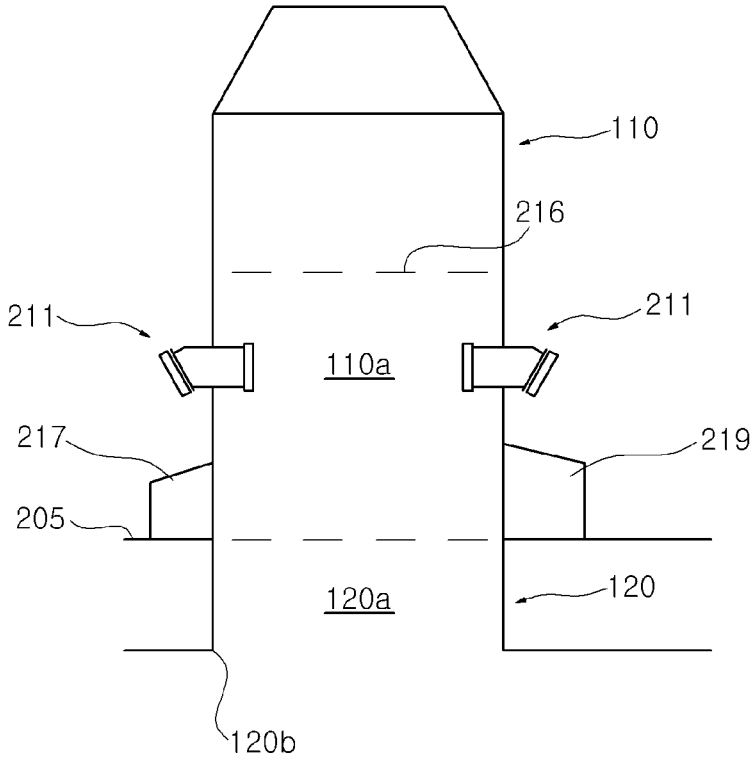
FIG. 4 is a schematic view illustrating a damper unit of an arctic ship with a derrick according to a second embodiment of the present invention.
Figure 5:
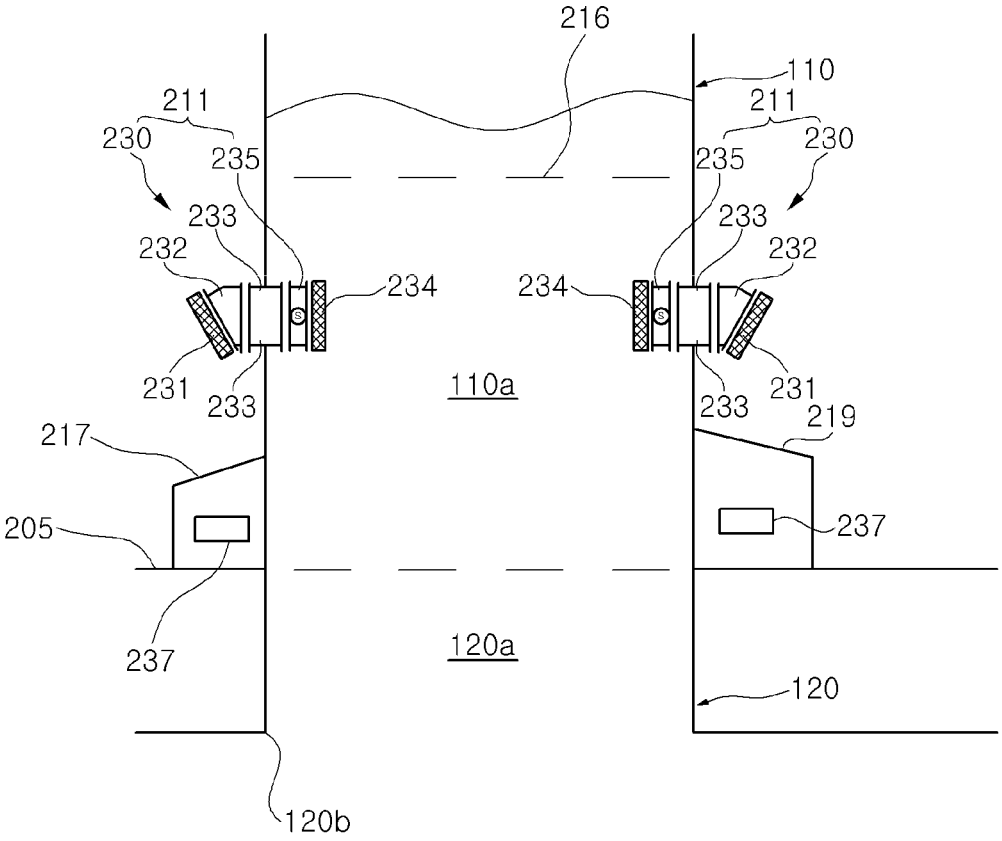
FIG. 5 is an enlarged view illustrating the connection of a derrick and a duct.

FIG. 4 is a schematic view illustrating a damper unit of an arctic ship with a derrick according to a second embodiment of the present invention, and FIG. 5 is an enlarged view illustrating the connection of a derrick and a duct in the arctic ship of FIG. 4.

As illustrated in FIGS. 4 and 5, the arctic ship with the derrick according to the second embodiment of the present invention includes a derrick 110 forming an enclosed space blocked from outside air, and a moonpool 120 coupled to a lower portion of the enclosed derrick 110 to communicate with the derrick 110 and blocked from the outside air.

The enclosed derrick 110 has a first inner space 110*a*, and the moonpool 120 has a second inner space 120*a*. The first inner space 110*a* and the second inner space 120*a* are coupled to communicate with each other. The enclosed derrick 110 is disposed on a drill floor 205 of the ship, and the moonpool 120 is disposed under the drill floor 205.

An outer wall of the derrick 110 is formed as an enclosed structure, and first and second enclosed tunnels 217 and 219 are provided in a side of the derrick 110. Openings are formed at the ends of the first and second enclosed tunnels 217 and 219, such that equipment such as a riser can be passed therethrough.

Meanwhile, an inlet/output port 120*b* is formed at a lower portion of the moonpool 120, and seawater wave may be transferred through the inlet/output port 120*b*. Due to the influence of waves, excessive negative pressure or positive pressure may be generated in the first and second inner spaces 110*a* and 120*a*.

Therefore, one or more damper units 211 as air supply/exhaust devices may be installed in at least one side of the enclosed derrick 110. Since air is supplied to or discharged from the first inner space 110*a* by the damper units 211, it is possible to compensate or offset the excessive negative pressure or positive pressure generated in the first and second inner spaces 110*a* and 120*a*. Thus, the pressures of the first and second inner spaces 110*a* and 120*a* can be constantly maintained, thereby safely protecting internal equipment, workers, and working conditions.

The damper unit 211 includes one or more communication ducts 230 which are installed in a side of the enclosed derrick 110 and communicate the outer space of the derrick 110 with the inner space of the derrick 110, and one or more open/close dampers 235 which open or close the communication ducts 230. An end of the communication duct 230 in the outer space side may be inclined downward.

The communication duct 230 may include a curved duct 232 and a straight penetration duct 233. Open/close dampers 235 may be installed in the curved duct 232 and the penetration duct 233 to selectively open or close the curved duct 232 and the penetration duct 233.

In particular, the damper unit 211 is disposed under a fingerboard 216, such that the operation of compensating and offsetting the pressures of the first and second inner spaces 110*a* and 120*a* is effectively performed.

One or more meshes may be installed in at least one of both ends of the communication duct 230. Meshes 231 and 234 installed in both ends of the communication duct 230 are illustrated in FIG. 5. An open/close damper 235 may be installed in a front end of the mesh 234 installed in the end of the communication duct 230 within an inner space side.

An outer end of the curved duct 232 is inclined downward and communicates with the outer space of the enclosed derrick 110, and inner end of the penetration duct 233 communicates with the first inner space 110*a*. The mesh 234 may be installed at the inner end of the penetration duct 233. The open/close damper 235 may be installed between the inner end of the penetration duct 233 and the mesh 234. The meshes 231 and 234 can minimize the inflow of external particles.

It is preferable that the penetration duct 233 is coupled to the inner end of the curved duct 232, and the penetration duct 233 is fixed to the sidewall of the derrick 110.

When an excessive positive pressure (more than 25 Pa) and an excessive negative pressure (less than −75 Pa) are generated in the inside of the derrick 110, the open/close damper 235 may be opened or closed manually or automatically in order to offset the excessive positive or negative pressure. In addition, the open/close damper 235 may be selectively closed to block an air flow in the event of a fire or other emergency.

A control unit 237 is installed in one side of the derrick 110 to control the opening/closing operation of the open/close damper 235. The control unit 237 may be installed in the first and second enclosed tunnels 217 and 219. The control unit 237 detects an internal pressure state of the derrick 110 in real time and controls the opening/closing operation of the open/close damper 235 manually or automatically. In this manner, the control unit 237 may control the internal pressure of the derrick 110 by supplying air to the inside of the enclosed derrick 110 or exhausting air to the outside of the enclosed derrick 110.

According to the embodiments of the present invention, the negative pressure or the positive pressure generated in the enclosed derrick 110 and the moonpool 120 due to influence of waves transferred to the moonpool 120 can be effectively compensated or offset, thereby safely protecting internal equipment, workers and working conditions inside the enclosed derrick 110 and the moonpool 120.

Furthermore, the downwardly curved duct 232 and the meshes 231 and 234 can minimize the inflow of external rainwater or foreign particles.

Figure 6:
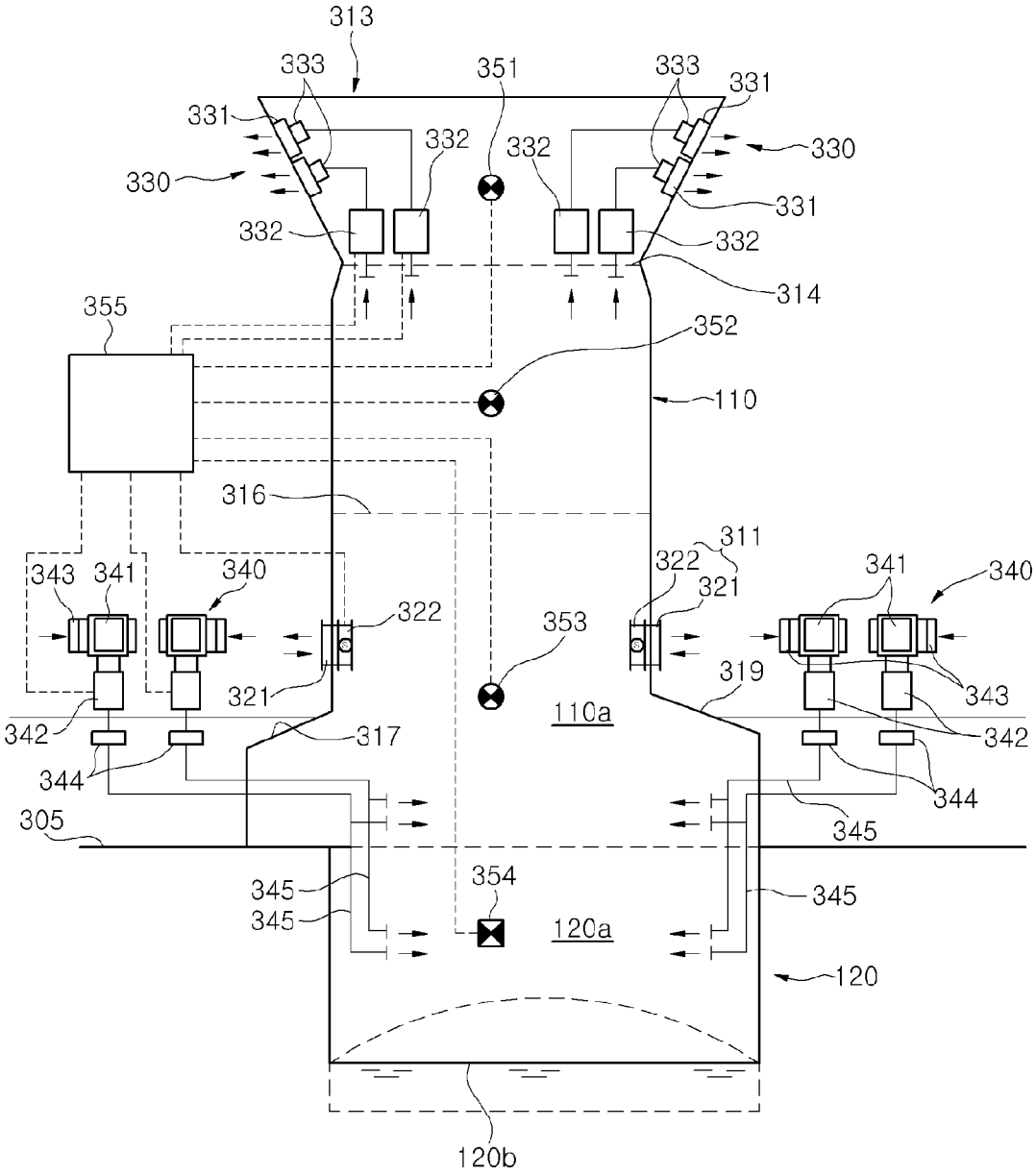
FIG. 6 is a schematic view illustrating a system for monitoring temperature and pressure of an arctic ship with a derrick according to a third embodiment of the present invention.

FIG. 6 is a schematic view illustrating a system for monitoring temperature and pressure of an arctic ship with a derrick according to a third embodiment of the present invention.

In the arctic ship with the derrick according to the third embodiment of the present invention, an enclosed derrick 110 is installed on a drill floor 305 of an arctic ship, and a moonpool 120 is disposed under the enclosed derrick 110.

As illustrated in FIG. 6, the arctic ship with the derrick according to the third embodiment of the present invention may include one or more temperature sensors 351, 352 and 353 and a pressure sensor 354, which monitor an internal temperature and pressure of the derrick 110.

A control unit 355 may be further installed to maintain or control air conditions of inner spaces 110*a* and 120*a* of the derrick 110 or the moonpool 120 within a predetermined range by supplying outside air to the inner spaces 110*a* and 120*a* of the derrick 110 or the moonpool 120 or exhausting air from the inner spaces 110*a* and 120*a* thereof, such that, based on the internal temperature and pressure monitored by the temperature sensors 351, 352 and 353 and the pressure sensor 354.

The derrick 110 has a first inner space 110*a*, and the moonpool 120 has a second inner space 120*a*. The first inner space 110*a* and the second inner space 120*a* are coupled to communicate with each other. The derrick 110 is disposed on the drill floor 305 of the ship, and the moonpool 120 is disposed under the drill floor 305.

An outer wall of the derrick 110 is formed in an enclosed structure, and first and second enclosed tunnels 317 and 319 are provided on sides of the enclosed derrick 110. Openings are formed at the ends of the first and second enclosed tunnels 317 and 319, such that equipment such as a riser can be passed therethrough.

Supply units 340 may be installed outside the enclosed derrick 110 to supply outside air from the outside of the enclosed derrick 110 and the moonpool 120 to the first inner space 110*a* and the second inner space 120*a*.

The supply unit 340 may include one or more inlet ports 341 installed at the outside of the drill floor 305, one or more supply fans 342 coupled to the inlet ports 341, one or more heaters 343 installed adjacent to the inlet ports 341, and one or more open/close valves 344 installed at a downstream side of the supply fan 342 to selectively allow the inflow of the outside air.

The supply fan 342 may be coupled to a lower portion of the inlet port 341 and configured to forcibly blow the outside air to the second inner space 120*a* of the moonpool 120. The outside air forcibly blown by the supply fan 342 may be supplied through an air supply pipe 345 to the second inner space 120*a* or the lower portion of the first inner space 110*a*.

When a temperature is low in an extremely cold region (below 0° C.), the heater 343 heats the outside air introduced through the inlet port 341. The heated air is supplied to the first and second inner spaces 110*a* and 120*a* by the supply fan 342. Accordingly, internal equipment, workers, and working conditions can be safely protected and maintained from external extreme environments.

The open/close valve 344 may be selectively opened or closed to block an air flow in the event of a fire or other emergency or in the repair of the supply fan 342.

An exhaust unit 330 may be installed at an upper portion of the derrick 110. When the outside air is supplied to the second inner space 120*a* of the moonpool 120 by the supply unit 340, the exhaust unit 330 guides the outside air to flow upwardly from the second inner space 120*a* of the moonpool 120 to the upper portion of the first inner space 110*a* of the derrick 110.

The exhaust unit 330 includes one or more exhaust ports 331 installed at an upper portion of the derrick 110, and one or more exhaust fans 332 coupled to the exhaust ports 331.

The exhaust fan 332 may be installed within a crown block section 313 and coupled to an open/close valve 333. The open/close valve 333 may be selectively opened or closed to block an air flow in the event of a fire or other emergency or in the repair of the exhaust fan 332.

An inlet/output port 120*b* is formed at a lower portion of the moonpool 120, and seawater wave may be transferred through the inlet/output port 120*b*. Due to the influence of waves, excessive negative pressure or positive pressure may be generated in the first and second inner spaces 110*a* and 120*a*.

Therefore, one or more damper units 311 are installed on at least one side of the derrick 110. Since air is supplied to or discharged from the first inner space 110*a* by the damper units 311, it is possible to compensate or offset the excessive negative pressure or positive pressure generated in the first and second inner spaces 110*a* and 120*a*.

Thus, the pressures of the first and second inner spaces 110*a* and 120*a* can be constantly maintained, thereby safely protecting internal equipment, workers, and working conditions.

As described above in the second embodiment shown in FIG. 5, the damper unit 311 may include one or more communication ducts 321 installed in the sides of the derrick 110 to communicate the outer space of the derrick 110 with the inner space of the derrick 110, and an open/close valve 322 coupled to the communication ducts 321 to selectively open or close the communication ducts 321.

The temperature sensors 351, 352 and 353 are installed in the first inner space 110*a* of the derrick 110 to monitor an internal temperature of the derrick 110, and the pressure sensor 354 is installed in the second inner space 120*a* of the moonpool 120 to monitor an internal pressure difference of the moonpool 120.

The temperature sensors 351, 352 and 353 may include a first temperature sensor 351 installed at an upper portion of the first inner space 110*a*, a second temperature sensor 352 installed at a middle portion of the first inner space 110*a*, and a third temperature sensor 353 installed at a lower portion of the first inner space 110*a*.

The first temperature sensor 351 may be installed adjacent to the exhaust unit 330, which is installed at an upper portion of the derrick 110. In particular, if a top board 314 is disposed at an upper portion of the derrick 110, the first temperature sensor 351 may be installed on the top board 314.

The second temperature sensor 352 may be installed on a fingerboard 316 of the derrick 110, and the third temperature sensor 353 may be installed between the fingerboard 316 of the derrick 110 and the drill floor 305.

As such, in the arctic ship with the derrick according to the third embodiment of the present invention, since the first to third temperature sensors 351, 352 and 353 are installed in three partitioned regions of the first inner space 110*a*, respectively, the temperature of the first inner space 110*a* can be exactly measured or monitored.

The pressure sensor 354 may be installed in the second inner space 120*a* to precisely measure or monitor a pressure difference generated in the second inner space 120*a*. In particular, the influence of waves may generate excessive negative pressure or positive pressure in the second inner space 120*a*. In this case, the pressure sensor 354 can exactly measure or monitor a variation in the pressure of the second inner space 120*a* by precisely measuring or monitoring the negative pressure or the positive pressure.

The arctic ship with the derrick according to the third embodiment of the present invention can exactly check the abnormal operations of the supply unit 340 and the exhaust unit 330 for ventilation and the abnormal operation of the damper unit 311 for pressure compensation through the first to third temperature sensors 351, 352 and 353 and the pressure sensor 354.

In addition, since the arctic ship with the derrick according to the third embodiment of the present invention can precisely control the operation of the supply unit 340, the exhaust unit 330, and the damper unit 311, based on the temperature and pressure information monitored through the first to third temperature sensors 351, 352 and 353 and the pressure sensor 354, it is possible to effectively cope with dangers of abnormal temperature and abnormal pressure in the first and second inner spaces 110*a* and 120*a*. Therefore, it is possible to ensure the safety of workers, equipment and working conditions inside the enclosed derrick 110 and the moonpool 120.

As one example, it is possible to cope with the abnormal temperatures of the first and second inner spaces 110*a* and 120*a* by precisely controlling the operation of the heater 343, the supply unit 340, the exhaust unit 330, or the damper unit 311 such that the internal temperatures of the first and second inner spaces 110*a* and 120*a* are maintained in the range from −20° C. to 45° C. according to the temperature values monitored by the first to third temperature sensors 351, 352 and 353. In most cases, the operation of the damper unit 311 is controlled.

In addition, it is possible to cope with the abnormal pressures of the first and second inner spaces 110*a* and 120*a* by classifying the internal pressures of the first and second inner spaces 110*a* and 120*a* into a normal case and an abnormal case (arctic region, typhoon, etc.) according to environment conditions (wave and external temperature).

In the normal case, it is preferable that the pressures of the first and second inner spaces 110*a* and 120*a* are maintained at −25 Pa. In the abnormal case, it is preferable that the pressures of the first and second inner spaces 110*a* and 120*a* are maintained in the range from −75 Pa to 25 Pa. At this time, a pressure maintaining unit controls the operation of the damper unit 311. The damper unit 311 may be controlled manually or automatically.

Moreover, a control unit 355 may be installed to connect to each piece of equipment in order to automatically control the supply fan 342, the heater 343, the open/close valve 344, the supply unit 340, the exhaust unit 330, the damper unit 311, the temperature sensors 351, 352 and 353, or the pressure sensor 354.

Figure 7:
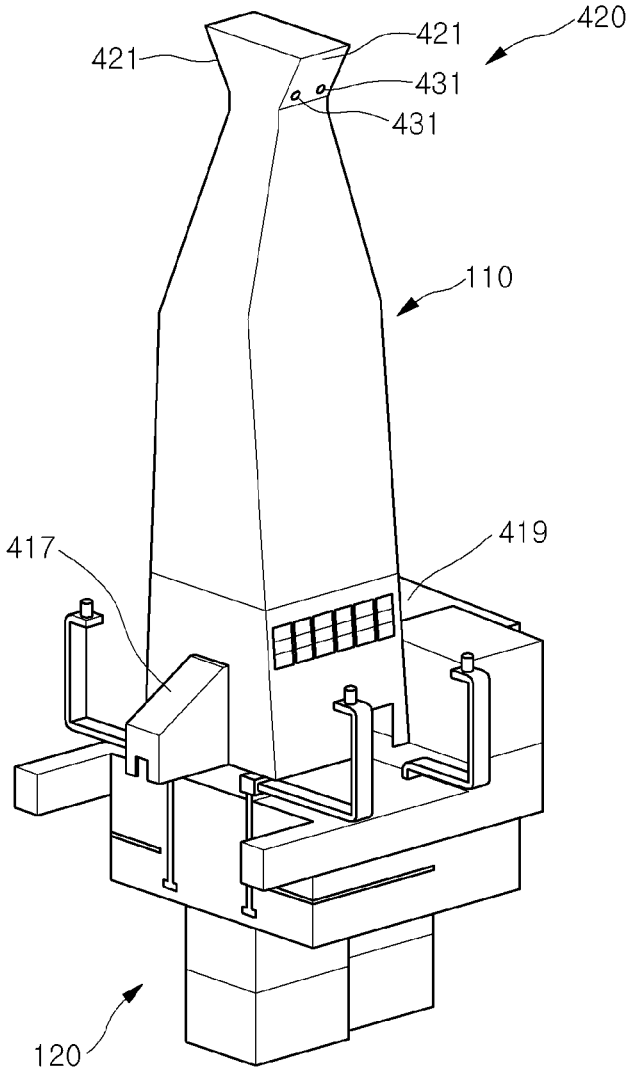
FIG. 7 is a perspective view illustrating a derrick structure of an arctic ship with a derrick according to a fourth embodiment of the present invention.
Figure 8:
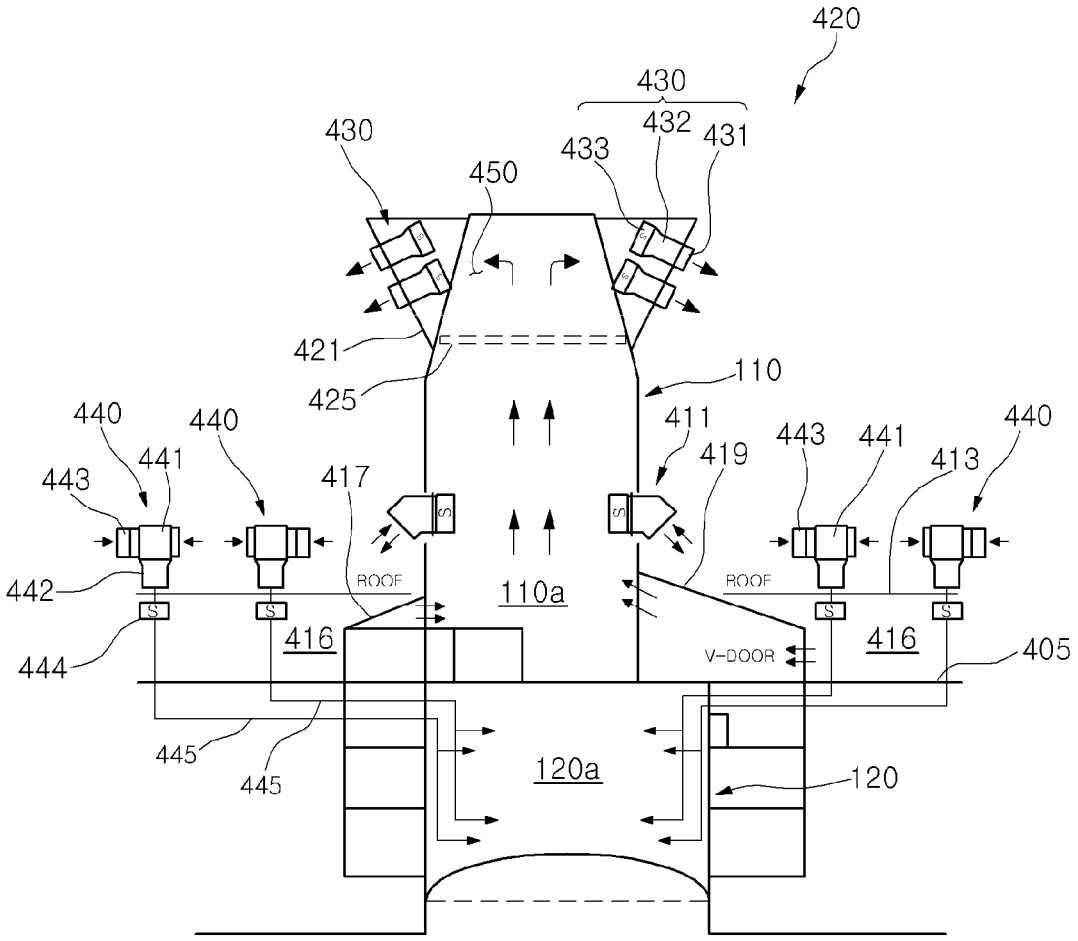
FIG. 8 is a cross-sectional view illustrating the derrick structure and a ventilating apparatus installed in the arctic ship with the derrick according to the fourth embodiment of the present invention.

FIG. 7 is a perspective view illustrating a derrick structure of an arctic ship with a derrick according to a fourth embodiment of the present invention, and FIG. 8 is a cross-sectional view illustrating the derrick structure and a ventilating apparatus installed in the arctic ship with the derrick according to the fourth embodiment of the present invention.

The arctic ship with the derrick according to the fourth embodiment of the present invention includes an enclosed derrick 110 installed on a drill floor 405 of the arctic ship, and a moonpool 120 disposed under the enclosed derrick 110.

The derrick 110 and the moonpool 120 are coupled such that inner spaces 110*a* and 120*b* thereof communicate with each other. The enclosed derrick 110 is disposed on the drill floor 405 of the ship, and the enclosed moonpool 120 is disposed under the drill floor 405.

An outer wall of the enclosed derrick 110 is formed as an enclosed structure. The outer wall of the enclosed derrick 110 may be made of a fiberglass reinforced polymer (FRP), a stainless steel sheet (SUS sheet), a zinc alloy structure, or a sandwich panel.

Enclosed tunnels 417 and 419 are provided at sides of the enclosed derrick 110. Openings are formed at the ends of the enclosed tunnels 417 and 419, such that equipment such as a riser can be passed therethrough. The enclosed tunnels 417 and 419 are adjacent to riser tensioner rooms 416.

Supply units 440 are installed outside the enclosed derrick 110 to supply outside air from the outside of the enclosed derrick 110 to an inner space of the enclosed derrick 110 or an inner space 120*a* of the moonpool 120.

The supply unit 440 may include one or more inlet ports 441 installed at the outside of the drill floor 405, one or more supply fans 442 coupled to the inlet ports 441, one or more heaters 443 installed adjacent to the inlet ports 441, and one or more open/close valves 444 installed at a downstream side of the supply fans 442 to selectively allow the inflow of the outside air.

The inlet port 441 may be installed at a roof 413 side of the riser tensioner room 416, and the outside air is introduced through the inlet port 441.

The supply fan 442 may be coupled to a lower portion of the inlet port 441 and configured to forcibly blow the outside air to the inner space 120*a* of the moonpool 120. The outside air forcibly blown by the supply fan 442 may be supplied through a supply pipe 445 to the inner space 120*a* of the enclosed moonpool 120 or the lower portion of the inner space 110*a* of the enclosed derrick 110.

When a temperature is low in an extremely cold region (in particular, below 0° C. like a winter season), the heater 443 heats the outside air introduced through the inlet port 441. The heated air is supplied to the inner spaces 120*a* and 110*a* of the moonpool 120 and the derrick 110 by the supply fan 442. Accordingly, internal equipment, workers, and working conditions can be safely protected and maintained from external extreme environments.

The open/close valve 444 may be selectively opened or closed to block an air flow in the event of a fire or other emergency or in the repair of the supply fan 442.

Meanwhile, an exhaust unit 430 may be installed at an upper portion of the derrick 110. When the outside air is supplied to the inner space 120*a* of the moonpool 120 by the supply unit 440, the exhaust unit 430 guides the outside air to flow upwardly from the inner space 120*a* of the enclosed moonpool 120 to the upper portion of the inner space 110*a* of the enclosed derrick 110.

The upper portion of the enclosed derrick 110 forms a crown block section 420. A crown block (not shown) is installed inside the crown block section 420. The width of the crown block section 420 is gradually widened upwardly, and thus, an installation workspace 450 may be formed inside the crown block section 420. The width of the installation workspace 450 is also gradually widened upwardly.

In particular, an inclined plane 421 may be provided in at least one side of the crown block section 420, and the exhaust unit 430 may be installed on the inclined plane 421. In FIGS. 7 and 8, a pair of inclined planes 421 is symmetrically formed on both sides of the crown block section 420, and the exhaust units 430 are installed on the respective inclined planes 421.

The lower portion of the installation workspace 450 communicates with the inner space 110*a* of the derrick 110. A crown block platform 425 is installed to cross the lower portion of the installation workspace 450. The crown block (not shown) is installed on the crown block platform 425.

In the arctic ship with the derrick according to the fourth embodiment of the present invention, as the crown block section 420 whose upper width becomes gradually wider is installed at the upper portion of the enclosed derrick 110, the installation workspace 450 formed inside the crown block section 420 is gradually widened upwardly.

Accordingly, the installation workspace 450 provides a space enough to install the exhaust unit 430 on the side of the crown block section 420 by using the crown block platform 425, installed in the installation workspace 450, and to allow a worker to perform a maintenance task on the exhaust unit 430. Hence, the worker can perform the maintenance task effectively and safely.

By installing the exhaust unit 430 at the upper portion of the enclosed derrick 110, effective airflow is achieved within the enclosed derrick 110 and the enclosed moonpool 120. Therefore, internal equipment, workers, and working conditions can be protected and maintained safely and effectively.

The exhaust unit 430 includes one or more exhaust ports 431 installed in the inclined plane 421, and one or more exhaust fans 432 coupled to the exhaust ports 431.

The exhaust fan 432 is installed within the crown block section 420 and is coupled to an open/close valve 433. The open/close valve 433 may be selectively opened or closed to block airflow in the event of a fire or other emergency or in the repair of the exhaust fan 432.

In the arctic ship with the derrick according to the fourth embodiment of the present invention, as described above, since the crown block section 420 whose upper width becomes gradually wider is installed at the upper portion of the enclosed derrick 110, the crown block platform 425 can be utilized without additional installation of ducts, and a workspace enough to install the exhaust unit 430 can be provided. Therefore, the worker can easily install the exhaust unit 430 at the upper portion of the enclosed derrick 110 and can more effectively perform the maintenance task on the exhaust unit 430. Moreover, the worker's safety can be improved.

In the arctic ship with the derrick according to the fourth embodiment of the present invention, since outside air is supplied to the enclosed moonpool 120 and is exhausted through the upper portion of the enclosed derrick 110, airflow from the enclosed moonpool 120 to the upper portion of the enclosed derrick 110 is effectively achieved. Therefore, internal equipment, workers, and working conditions within the enclosed derrick 110 can be safely protected and maintained from external extreme environments.

Although the technical structures of the arctic ships with the derrick according to the embodiments of the present invention are described differently in the respective embodiments for convenience of explanation, it is apparent that other embodiments may also be provided by combining the configurations with different technical structures.

According to the embodiments of the present invention, the enclosed derrick and the moonpool make it possible for workers to efficiently perform tasks in the arctic region, and the temperature and pressure of the inner spaces of the moonpool and the derrick can be maintained at appropriate levels, thereby ensuring the safety of internal equipment, workers, and working conditions.

Since the derrick and the moonpool have the enclosed spaces blocked from the exterior in order for preventing freezing, it is possible to minimize the influence of the temperature and pressure of the space formed by the derrick and the moonpool according to the external temperature and waves.

The negative pressure or the positive pressure generated in the enclosed derrick and the moonpool due to influence of waves transferred to the moonpool can be effectively compensated or offset, thereby safely protecting internal equipment, workers and working conditions inside the enclosed derrick and the moonpool.

Furthermore, the downwardly curved duct and the meshes can minimize the inflow of external rainwater or foreign particles.

The internal temperature and pressure of the enclosed derrick structure can be appropriately monitored by the temperature sensors and the pressure sensor, thereby exactly checking the abnormal operation of the ventilating system.

Furthermore, since the damper unit or the like is precisely controlled based on the temperature and pressure information monitored by the temperature sensors and the pressure sensor, it is possible to effectively cope with dangers of abnormal temperature and abnormal pressure in the enclosed derrick and the enclosed moonpool. Therefore, it is possible to ensure the safety of workers, equipment and working conditions inside the enclosed derrick and the enclosed moonpool.

Since the crown block section whose upper width becomes gradually wider is installed at the upper portion of the enclosed derrick, the operation of installing the exhaust unit at the upper portion of the enclosed derrick and the operation of maintaining the exhaust unit can be performed using the crown block platform. Therefore, the installation costs for additional ducts can be saved, and the worker's safety can be improved.

Furthermore, the space for the installation of the exhaust fan and the workspace for the maintenance of the exhaust fan can be provided at the upper portion of the enclosed derrick.

Moreover, since outside air is supplied to the enclosed moonpool and is exhausted through the upper portion of the enclosed derrick, the air flow from the enclosed moonpool to the upper portion of the enclosed derrick is effectively achieved. Therefore, internal equipment, workers, and working conditions within the enclosed derrick 110 can be safely protected and maintained from external extreme environments.

While the embodiments of the present invention have been described with reference to specific embodiments, it will be apparent to those skilled in the art that various changes and modifications may be made without departing from the spirit and scope of the invention as defined in the following claims. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An arctic ship, comprising:

a derrick defining an enclosed space blocked from outside air;

a moonpool coupled to a lower portion of the derrick to communicate with the derrick and blocked from the outside air;

an air supply/exhaust device installed to communicate an inner space of the derrick or the moonpool with a region exterior to the derrick, the air supply/exhaust device comprising a supply unit including a supply fan to supply the outside air to the derrick or the moonpool, and comprising an exhaust unit including an exhaust fan to exhaust the supplied outside air through an upper portion of the derrick;

one or more temperature sensors installed inside of the derrick to monitor an internal temperature of the derrick;

one or more pressure sensors installed inside of the moonpool to monitor an internal pressure of the moonpool; and a control unit to control the operations of the supply unit and the exhaust unit based on internal temperature and pressure information monitored by the one or more temperature sensors and the one or more pressure sensors, wherein air condition of the inner space is maintained or controlled at a predetermined range by the air supply/exhaust device, and wherein the arctic ship has a structure enclosed from the derrick to the moonpool, and compensates or offsets a negative pressure or a positive pressure generated in the enclosed derrick and the moonpool due to influence of waves transferred to the moonpool.

2. The arctic ship according to claim 1, wherein the supply unit comprises a heater to heat the supplied outside air.

3. The arctic ship according to claim 1, wherein the supply unit and/or the exhaust unit comprises an open/close valve which opens or closes a flow of supplied or exhausted air.

4. The arctic ship according to claim 1, wherein the supply unit and/or the exhaust unit comprises a supply louver which prevents the inflow of large particles and rainwater.

5. The arctic ship according to claim 1, wherein the air supply/exhaust device further comprises an openable/closable air supply port through which the outside air is supplied to the derrick.

6. The arctic ship according to claim 1, further comprising a heat blower provided inside the derrick to heat air to assist with ventilation.

7. The arctic ship according to claim 1, wherein the operating speeds of the supply fan and the exhaust fan are changed depending on temperature of the outside air.

8. The arctic ship according to claim 1, further comprising:

a duct through which the outside air supplied by the supply unit is transferred to the derrick or the moonpool; and a wire mesh provided at an end of the duct which is coupled to the derrick or the moonpool.

9. The arctic ship according to claim 1, wherein the air supply/exhaust device comprises a damper unit installed in at least one side of the derrick to selectively supply air to the inside of the derrick or exhaust air from the inside of the derrick.

10. The arctic ship according to claim 9, wherein the damper unit comprises:

one or more communication ducts communicating an outer space of the derrick with an inner space of the derrick; and one or more open/close dampers coupled to the communication ducts to open or close the communication ducts.

11. The arctic ship according to claim 10, further comprising:

a mesh installed in an end of the communication duct within the inner space of the derrick; and an open/close damper installed adjacent the mesh installed in the end of the communication duct within the inner space of the derrick, and wherein an end of the communication duct in the outer space of the derrick is inclined downward.

12. The arctic ship according to claim 10, further comprising:

a fingerboard provided in an upper inner side of the derrick, wherein the damper unit is disposed under the fingerboard.

13. The arctic ship according to claim 1, wherein the temperature sensors comprise:

a first temperature sensor installed at an upper portion of the derrick;

a second temperature sensor installed at a middle portion of the derrick; and a third temperature sensor installed at a lower portion of the derrick.

14. The arctic ship according to claim 13 wherein the exhaust unit is disposed in an upper inner side of the derrick, and further comprising:

a fingerboard disposed across a middle inner portion of the derrick, wherein the first temperature sensor is disposed adjacent to the exhaust unit, the second temperature sensor is disposed above the fingerboard, and the third temperature sensor is disposed under the fingerboard of the derrick.

15. The arctic ship according to claim 1, further comprising a crown block section disposed at an upper portion of the enclosed derrick such that a crown block is installed and an installation workspace is formed thereinside, and wherein the air supply/exhaust device is installed in the crown block section such that the installation workspace communicates with the exterior.

16. The arctic ship according to claim 15, further comprising:

open/close valves installed in the exhaust unit and the supply unit to selectively allow an outside air flow.

17. The arctic ship according to claim 16, wherein the width of the crown block section is widened upwardly, and the width of the installation workspace is widened upwardly.

18. The arctic ship according to claim 17, wherein a pair of inclined planes are symmetrically formed on both sides of the crown block section, such that an upper circumference of the crown block section is formed to be wider than a lower circumference thereof.

* * * * *